US010347199B2

(12) United States Patent
Guo et al.

(10) Patent No.: US 10,347,199 B2
(45) Date of Patent: Jul. 9, 2019

(54) DRIVING METHODS AND DRIVING DEVICES OF DISPLAY PANELS

(71) Applicant: Wuhan China Star Optoelectronics Technology Co., Ltd., Wuhan, Hubei (CN)

(72) Inventors: Xingling Guo, Guangdong (CN); Xiaoping Tan, Guangdong (CN); Jiehui Qin, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 245 days.

(21) Appl. No.: 15/325,082

(22) PCT Filed: Jan. 7, 2017

(86) PCT No.: PCT/CN2017/070531

§ 371 (c)(1),
(2) Date: Jan. 9, 2017

(87) PCT Pub. No.: WO2018/113050

PCT Pub. Date: Jun. 28, 2018

(65) Prior Publication Data

US 2018/0330677 A1 Nov. 15, 2018

(30) Foreign Application Priority Data

Dec. 20, 2016 (CN) ..... 2016 1 11878432

(51) Int. Cl.
*G09G 3/20* (2006.01)
*G09G 3/36* (2006.01)

(52) U.S. Cl.
CPC ..... *G09G 3/3607* (2013.01); *G09G 3/2003* (2013.01); *G09G 3/2007* (2013.01);
(Continued)

(58) Field of Classification Search
CPC ..... G09G 3/2007; G09G 3/3607; G09G 3/36; G09G 3/34; G09G 3/20; G09G 3/00;
(Continued)

(56) References Cited

U.S. PATENT DOCUMENTS

2004/0178974 A1* 9/2004 Miller ..... G09G 3/3216 345/82
2005/0231534 A1* 10/2005 Lee ..... G09G 3/2003 345/690

(Continued)

FOREIGN PATENT DOCUMENTS

CN 104376833 A * 2/2015 ..... G09G 5/02
WO WO-2016078100 A1 * 5/2016 ..... G09G 5/02
WO WO-2018113050 A1 * 6/2018 ..... G09G 3/2003

OTHER PUBLICATIONS

PCT/CN2017/070531 written opinion with partial English translation and search report with English translation. (Year: 2017).*

*Primary Examiner* — Julie Anne Watko
(74) *Attorney, Agent, or Firm* — Andrew C. Cheng

(57) ABSTRACT

The present disclosure relates to a driving method and a driving device of display panels. The driving method includes: obtaining three-color sub-pixel data of each of pixels of a current image, obtaining a saturation value corresponding to each of the pixels in accordance with the three-color sub-pixel data of each of the pixels, obtaining a current background-white ratio in accordance with the three-color sub-pixel data and the saturation value of each of the pixels, determining whether the current background-white ratio is within a predetermined adjustment range, and reducing a white grayscale value of four-color sub-pixel data of the current image in accordance with the current background-white ratio and outputting the reduced white grayscale value to a display panel. In this way, the darker pure-color effect due to the high contrast may be reduced,
(Continued)

which effectively enhances the darker pure-color issue of the RGBW display panel.

13 Claims, 2 Drawing Sheets

(52) U.S. Cl.
CPC ..... *G09G 2300/0452* (2013.01); *G09G 2320/0233* (2013.01); *G09G 2320/0238* (2013.01); *G09G 2320/0242* (2013.01); *G09G 2320/0271* (2013.01); *G09G 2320/0666* (2013.01); *G09G 2320/0686* (2013.01); *G09G 2340/06* (2013.01); *G09G 2360/16* (2013.01)

(58) Field of Classification Search
CPC ..... G09G 2320/0242; G09G 2320/02; G09G 2320/00; G09G 2320/0233; G09G 2320/06; G09G 2360/16; G09G 2360/00; G09G 2320/0646; G09G 2320/0686; G09G 2320/0271; G09G 2320/0276; G09G 3/2003; G09G 2300/0452; G09G 2320/0238; G09G 2320/0666; G09G 2340/06; H04N 9/68; H04N 9/64; H04N 9/00
See application file for complete search history.

(56) References Cited

U.S. PATENT DOCUMENTS

2012/0206513 A1* 8/2012 Ueno ..... G09G 3/3413 345/697
2013/0222436 A1* 8/2013 Park ..... G09G 5/06 345/690
2017/0270843 A1* 9/2017 Lee ..... G09G 3/2003
2018/0226031 A1* 8/2018 Guo ..... G09G 3/3426
2018/0226053 A1* 8/2018 Guo ..... G09G 5/02

* cited by examiner

DRIVING METHODS AND DRIVING DEVICES OF DISPLAY PANELS

BACKGROUND OF THE INVENTION

1. Field of the Invention

The present disclosure relates to liquid crystal display technology, and more particularly to a driving method and a driving device of display panels.

2. Discussion of the Related Art

Currently, RGB display panels includes a pixel cell array, wherein each of the pixels may include a red (R), a green (G), and a blue (B) sub-pixel cells. With the technical development, a white (W) sub-pixel cell may be also configured except for the R, G, B sub-pixel cells so as to form a RGBW display panel. By configuring the W sub-pixel cell, the pixel cell may include high transmission rate so as to reduce the power consumption of the display panel. However, as the total dimension of the RGB display panel remains the same regardless of the four sub-pixel cells (R, G, B, W) or the three sub-pixel cells (R, G, B) are configured, that is, the dimension of the four sub-pixel cells (R, G, B, W) is only ¼ of the total dimension, and the dimension of the three sub-pixel cells (R, G, B) is ⅓ of the total dimension. As such, the aperture rate of the display panel configured with the R, G, B, W sub-pixel cells ("RGBW display panel") is about 75% of the normal display panel configured with the R, G, B sub-pixel cells ("RGB display panel"). When a pure-color image is displayed, the brightness of the RGBW display panel is lower than that of the RGB display panel, and the displayed image is darker. In addition, as the W sub-pixel cell is configured, the contrast of the image may be higher. When the user views the pure-color image, the user may feel that the pure-color image may be darker due to the higher contrast.

SUMMARY

The present disclosure relates to a driving method and a driving device of display panels for enhancing the darker brightness issue when the pure-color image is displayed by the RGBW display panel.

In one aspect, a driving method of display panels includes: obtaining three-color sub-pixel data of each of pixels of a current image; obtaining saturation values corresponding to each of the pixels in accordance with the three-color sub-pixel data of each of the pixels; obtaining a current background-white ratio in accordance with the three-color sub-pixel data and the saturation value of each of the pixels, wherein the current background-white ratio is a ratio of the number of the pixels having the saturation value and the three-color sub-pixel data matching predetermined conditions of the current image to a total number of pixels; determining whether the current background-white ratio is within a predetermined adjustment range; reducing a white grayscale value of four-color sub-pixel data of the current image in accordance with the current background-white ratio and outputting the reduced white grayscale value to a display panel upon determining whether the current background-white ratio is within the predetermined adjustment range; wherein the step of reducing the white grayscale value of the four-color sub-pixel data of the current image in accordance with the current background-white ratio further includes: obtaining a current enhanced coefficient corresponding to the current background-white ratio in accordance with a relationship between a predetermined background-white ratio and the enhanced coefficient; and reducing a white grayscale value of the four-color sub-pixel data corresponding to the current image in accordance with the current enhanced coefficient; wherein the step of determining whether the current background-white ratio is within the predetermined adjustment range further includes: determining whether the current background-white ratio is greater than the first predetermined value; and determining the current background-white ratio is within the predetermined adjustment range upon determining the current background-white ratio is greater than the first predetermined value.

Wherein the three-color sub-pixel data respectively includes a red grayscale value (R1), a green grayscale value (G1), and a blue grayscale value (B1), and wherein the step of obtaining the saturation values corresponding to each of the pixels in accordance with the saturation values of each of the pixels further includes:

$$s = \frac{\mathrm{Max}(R1 \cdot G1 \cdot B1) - \mathrm{Min}(R1 \cdot G1 \cdot B1)}{\mathrm{Max}(R1 \cdot G1 \cdot B1)};$$

wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

Wherein the step of obtaining the current background-white ratio in accordance with the three-color sub-pixel data and the saturation value of each of the pixels further includes: defining the pixels having the grayscale value greater than a second predetermined value as a first pixel set; defining the pixels in the first pixel set having the saturation value smaller than a third predetermined value as a second pixel set; defining the number of the pixels in the second pixel set as a first number; defining the total number of the pixels in the current image as a second number; wherein the background-white ratio is the ratio of the first number to the second number.

In another aspect, a driving method of display panels includes: obtaining three-color sub-pixel data of each of pixels of a current image; obtaining saturation values corresponding to each of the pixels in accordance with the three-color sub-pixel data of each of the pixels; obtaining a current background-white ratio in accordance with the three-color sub-pixel data and the saturation value of each of the pixels, wherein the current background-white ratio is a ratio of the number of the pixels having the saturation value and the three-color sub-pixel data matching predetermined conditions of the current image to a total number of pixels; determining whether the current background-white ratio is within a predetermined adjustment range; and reducing a white grayscale value of four-color sub-pixel data of the current image in accordance with the current background-white ratio and outputting the reduced white grayscale value to a display panel upon determining whether the current background-white ratio is within the predetermined adjustment range.

Wherein the step of reducing the white grayscale value of the four-color sub-pixel data of the current image in accordance with the current background-white ratio further includes: obtaining a current enhanced coefficient corresponding to the current background-white ratio in accordance with a relationship between a predetermined background-white ratio and the enhanced coefficient; and reducing a white grayscale value of the four-color sub-pixel data corresponding to the current image in accordance with the current enhanced coefficient.

Wherein the step of determining whether the current background-white ratio is within the predetermined adjustment range further includes: determining whether the current background-white ratio is greater than the first predetermined value; and determining the current background-white ratio is within the predetermined adjustment range upon determining the current background-white ratio is greater than the first predetermined value.

Wherein the three-color sub-pixel data respectively includes a red grayscale value (R1), a green grayscale value (G1), and a blue grayscale value (B1), and wherein the step of obtaining the saturation values corresponding to each of the pixels in accordance with the saturation values of each of the pixels further includes:

$$s = \frac{\mathrm{Max}(R1 \cdot G1 \cdot B1) - \mathrm{Min}(R1 \cdot G1 \cdot B1)}{\mathrm{Max}(R1 \cdot G1 \cdot B1)};$$

wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

Wherein the step of obtaining the current background-white ratio in accordance with the three-color sub-pixel data and the saturation value of each of the pixels further includes: defining the pixels having the grayscale value greater than a second predetermined value as a first pixel set; defining the pixels in the first pixel set having the saturation value smaller than a third predetermined value as a second pixel set; defining the number of the pixels in the second pixel set as a first number; defining the total number of the pixels in the current image as a second number; and wherein the background-white ratio is the ratio of the first number to the second number.

In another aspect, a driving device of display panels includes: a first obtaining module is configured to obtain three-color sub-pixel data of each of the pixels of a current image;

a second obtaining module connects to the first obtaining module, and the second obtaining module is configured to obtain saturation values corresponding to each of the pixels in accordance with the three-color sub-pixel of each of the pixels obtained by the first obtaining module; a third obtaining module connects to the first obtaining module and the second obtaining module, and the third obtaining module is configured to obtain a current background-white ratio of the current image in accordance with the three-color sub-pixel data of each of the pixels obtained by the first obtaining module and the saturation value obtained by the second obtaining module, wherein the current background-white ratio is a ratio of the number of the pixels having the saturation value and the three-color sub-pixel data matching predetermined conditions of the current image to a total number of pixels; a determination module connects to the third obtaining module, and the determination module is configured to determine whether the current background-white ratio obtained by the third obtaining module is within a predetermined adjustment range; and a processing module connects to the determination module, and the processing module is configured to reduce a white grayscale value of the four-color sub-pixel data of the current image in accordance with the current background-white ratio and output the reduced white grayscale value to a display panel.

Wherein the processing module includes: an obtaining unit is configured to obtain the current enhanced coefficient corresponding to the current background-white ratio in accordance with the relationship between the predetermined background-white ratio and the enhanced coefficient; and a processing unit connects to the obtaining unit, and the processing unit is configured to reduce the white grayscale value of the four-color sub-pixel data corresponding to the current image in accordance with the current enhanced coefficient obtained by the obtaining unit.

Wherein the step of determining whether the current background-white ratio obtained by the third obtaining module is within the predetermined adjustment range further includes: the determination module determines whether the current background-white ratio is greater than the first predetermined value; and determining the background-white ratio is within the predetermined adjustment range upon determining that the current background-white ratio is greater than the first predetermined value.

Wherein the three-color sub-pixel data respectively includes a red grayscale value (R1), a green grayscale value (G1), and a blue grayscale value (B1), and wherein the step of obtaining the saturation values corresponding to each of the pixels in accordance with the saturation values of each of the pixels further includes:

$$s = \frac{\mathrm{Max}(R1 \cdot G1 \cdot B1) - \mathrm{Min}(R1 \cdot G1 \cdot B1)}{\mathrm{Max}(R1 \cdot G1 \cdot B1)};$$

wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

Wherein the step of obtaining the current background-white ratio of the current image in accordance with the three-color sub-pixel data of each of the pixels and the saturation value executed by the third obtaining module further includes: defining the pixels having the grayscale value greater than the second predetermined value as a first pixel set; defining the pixels in the first pixel set having the saturation value smaller than the third predetermined value as a second pixel set; defining the number of the pixels in the second pixel set as a first number; and defining the total number of the pixels in the current image as a second number, wherein the background-white ratio is the ratio of the first number to the second number.

In view of the above, the driving method includes: obtaining three-color sub-pixel data of each of pixels of a current image, obtaining a saturation value corresponding to each of the pixels in accordance with the three-color sub-pixel data of each of the pixels, obtaining a current background-white ratio in accordance with the three-color sub-pixel data and the saturation value of each of the pixels, determining whether the current background-white ratio is within a predetermined adjustment range, and reducing a white grayscale value of four-color sub-pixel data of the current image in accordance with the current background-white ratio and outputting the reduced white grayscale value to a display panel. In this way, the darker pure-color effect due to the high contrast may be reduced, which effectively enhances the darker pure-color issue of the RGBW display panel.

DETAILED DESCRIPTION OF THE EMBODIMENTS

Embodiments of the invention will now be described more fully hereinafter with reference to the accompanying drawings, in which embodiments of the invention are shown.

Figure 1:
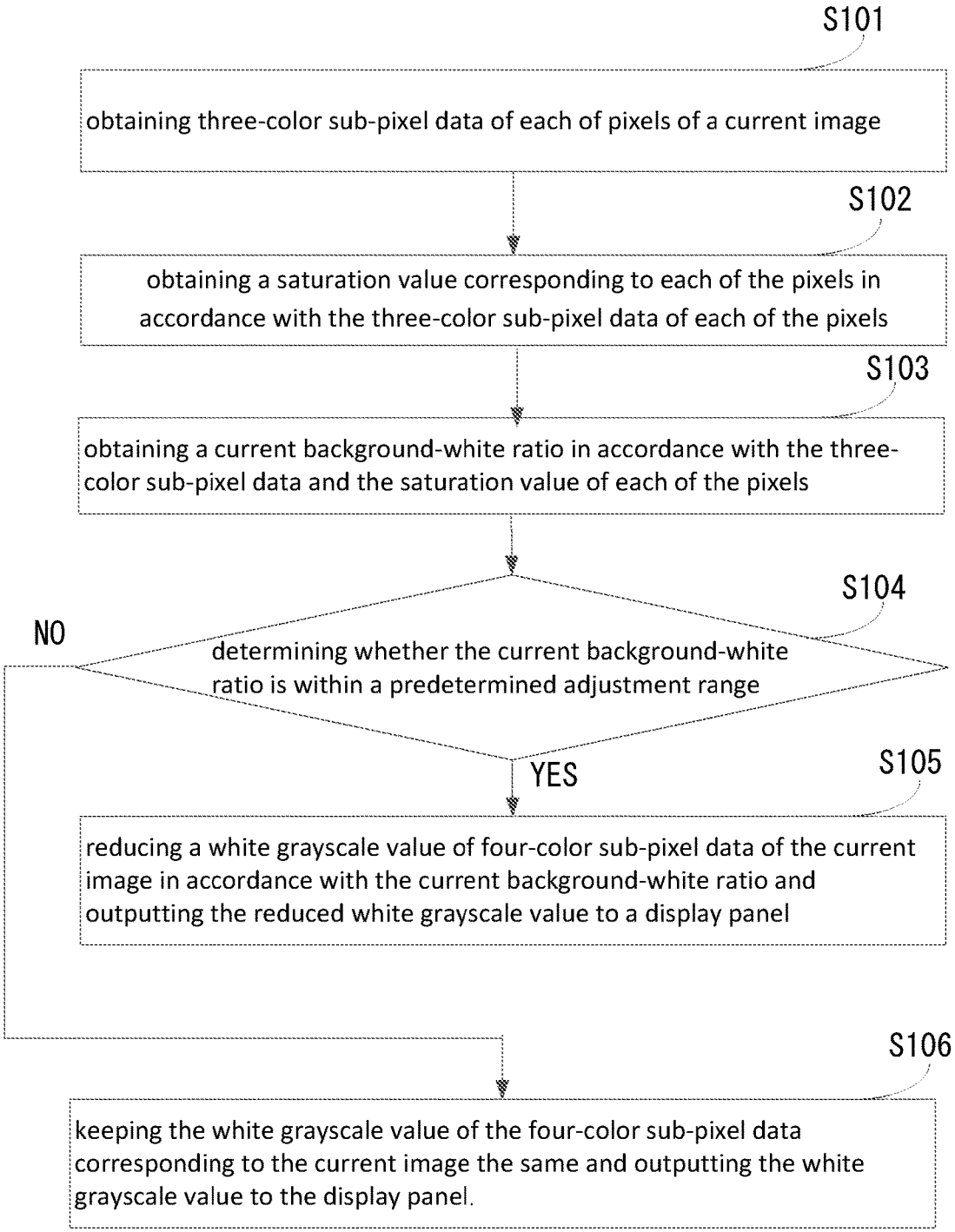
FIG. 1 is a flowchart illustrating the driving method in accordance with one embodiment.

FIG. 1 is a flowchart illustrating the driving method in accordance with one embodiment. It is to be noted that the driving method is not limited to the sequence of the steps shown in FIG. 1 provided that other sequence of the steps may achieve the substantial technical effect. The method includes the following steps.

In step S101, obtaining three-color sub-pixel data of each of pixels of a current image.

In step S101, the three-color sub-pixel data respectively includes a red grayscale value (R1), a green grayscale value (G1), and a blue grayscale value (B1).

In step S102, obtaining a saturation value corresponding to each of the pixels in accordance with the three-color sub-pixel data of each of the pixels.

In step S102, the saturation value corresponding to each of the pixels may be calculated in accordance with the equation below:

$$s = \frac{\mathrm{Max}(R1 \cdot G1 \cdot B1) - \mathrm{Min}(R1 \cdot G1 \cdot B1)}{\mathrm{Max}(R1 \cdot G1 \cdot B1)}$$

Wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

In step S103, obtaining a current background-white ratio in accordance with the three-color sub-pixel data and the saturation value of each of the pixels.

In step S103, the current background-white ratio is a ratio of the number of the pixels having the saturation value and the three-color sub-pixel data matching predetermined conditions of a current image to a total number of pixels.

In the embodiment, the predetermined conditions include: any one of the grayscale values out of the red grayscale value (R1), the green grayscale value (G1), and the blue grayscale value (B1) is greater than a second predetermined value. At the same time, the saturation value of the pixel is smaller than a third predetermined value. Preferably, the second predetermined value is 150, and the third predetermined value is 0.2.

In another aspect, the step of obtaining a current background-white ratio in accordance with the three-color sub-pixel data and the saturation value of each of the pixels further includes: with respect to the three-color sub-pixel data, defining the pixels having the grayscale value greater than the second predetermined value as a first pixel set; defining the pixels in the first pixel set having the saturation value smaller than the third predetermined value as a second pixel set; defining the number of the pixels in the second pixel set as a first number; defining the total number of the pixels in the current image as a second number; wherein the background-white ratio is the ratio of the first number to the second number.

It can be understood that the saturation value of the white color is zero, and the pixel having the saturation value lower than a threshold may be deemed as having the background as white.

In step S104, determining whether the current background-white ratio is within a predetermined adjustment range. If yes, the process goes to step S105, otherwise, the process goes to step S106.

In step S104, the step of determining whether the current background-white ratio is within a predetermined adjustment range further includes: determining whether the current background-white ratio is greater than the first predetermined value. When the current background-white ratio is greater than the first predetermined value, it is determined that the current image has the background with the low saturation value, and the process goes to step S105. When the current background-white ratio is smaller than the first predetermined value, it is determined that the current image is a pure-color image having the high saturation value, and the process goes to step S106.

In step S105, reducing a white grayscale value of four-color sub-pixel data of the current image in accordance with the current background-white ratio and outputting the reduced white grayscale value to a display panel.

In step S105, the step of reducing a white grayscale value of four-color sub-pixel data of the current image in accordance with the current background-white ratio further includes: obtaining a current enhanced coefficient corresponding to the current background-white ratio in accordance with a relationship between a predetermined background-white ratio and the enhanced coefficient; and reducing the white grayscale value of the four-color sub-pixel data corresponding to the current image in accordance with the current enhanced coefficient.

Figure 2:
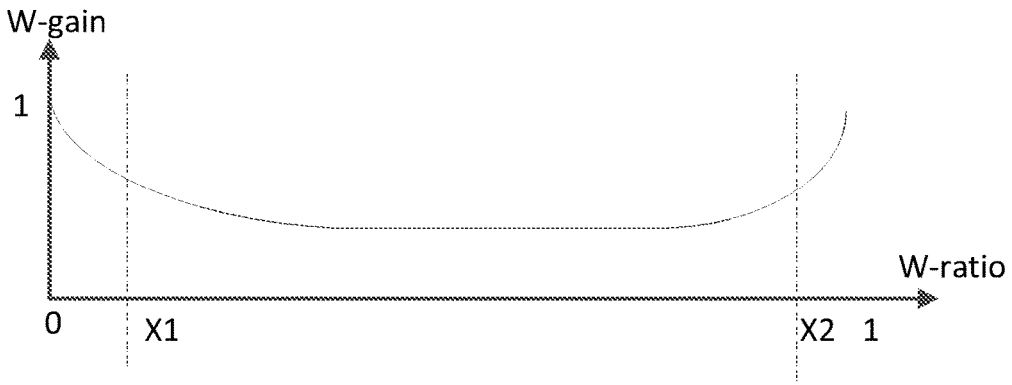
FIG. 2 is a curve diagram showing the background-white ratio and the enhanced coefficient.

FIG. 2 is a curve diagram showing the background-white ratio and the enhanced coefficient. As shown in FIG. 2, the x-axis (W-ratio) relates to the background-white ratio, and the W-ratio ranges from 0 to 1. The y-axis (W-gain) relates to the enhanced coefficient, and the W-gain ranges from 0 to 1. X1 is the first predetermined value, and the X2 is the fourth predetermined value.

When the background-white ratio is smaller, that is, when the background-white ratio is smaller than the first predetermined value (X1), the current image is the pure-color image having the high saturation value. At this moment, the enhanced coefficient is close to one, and the process goes to step S106. The process for darkening the background is not needed. When the background-white ratio is higher, that is, when the background-white ratio is greater than the first predetermined value (X1), the current image is the background having the lower saturation value. The process goes to step S105, and the process for darkening the background has to be conducted in accordance with the enhanced coefficient.

It can be understood that when the background-white ratio is great, that is, when the background-white ratio is greater than or equal to a fourth predetermined value, although the current image has the background having the low saturation value, the current image is brighter and has a few pure color. At this moment, the enhanced coefficient is close to one, and the process for darkening the background is not needed.

In other embodiments, the step of determining whether the current background-white ratio is within a predetermined adjustment range may also include: determining whether the current background-white ratio is within the predetermined adjustment range determined by the first predetermined value and the fourth predetermined value, wherein the fourth predetermined value is greater than the first predetermined value. If the current background-white ratio is within the predetermined adjustment range, that is, the current background-white ratio is greater than the first predetermined value (X1) and is smaller than the fourth predetermined value (X2), the process goes to step S105. Otherwise, the process goes to step S106.

In the embodiment, the step of reducing a white grayscale value of four-color sub-pixel data of the current image in accordance with the current enhanced coefficient further includes: adopting a product of the current enhanced coefficient and the white grayscale value of the four-color sub-pixel data to be the reduced white grayscale value. It can also be understood that the current enhanced coefficient ranges from 0 to 1. Thus, the product of the current enhanced coefficient and the white grayscale value of the four-color sub-pixel data results in the reduced white grayscale value. That is, the background of the current image is darker than that of the original image. In this way, when the current background-white ratio is within the predetermined adjustment range, the darker pure-color effect due to the high contrast may be reduced, which effectively enhances the darker pure-color issue of the RGBW display panel.

In addition, the four-color sub-pixel data corresponding to the current image is obtained by the three-color sub-pixel data of each of the pixels. Specifically, the four-color sub-pixel data corresponding to each of the pixels may be obtained by the equation below:

$$W2=\mathrm{Min}(R1,G1,B1);$$

$$G2=G1*\mathrm{Gain}-W2;$$

$$R2=R1*\mathrm{Gain}-W2;$$

$$B2=B1*\mathrm{Gain}-W2;$$

Wherein the four-color sub-pixel data respectively includes a red grayscale value (R2), a green grayscale value (G2), a blue grayscale value (B2), and a white grayscale value (W2). The three-color sub-pixel data are known, and includes the red grayscale value (R1), the green grayscale value (G1), and the blue grayscale value (B1), Gain represents a predetermined enhanced value, Min (R1, G1, B1) is the minimum value among the red grayscale value (R1), the green grayscale value (G1), and the blue grayscale value (B1).

In step S106, keeping the white grayscale value of the four-color sub-pixel data corresponding to the current image the same and outputting the white grayscale value to the display panel.

In step S106, when the current background-white ratio is not within the predetermined adjustment range, the white grayscale value of the four-color sub-pixel data corresponding to the current image remains the same and is outputted to the display panel.

Figure 3:
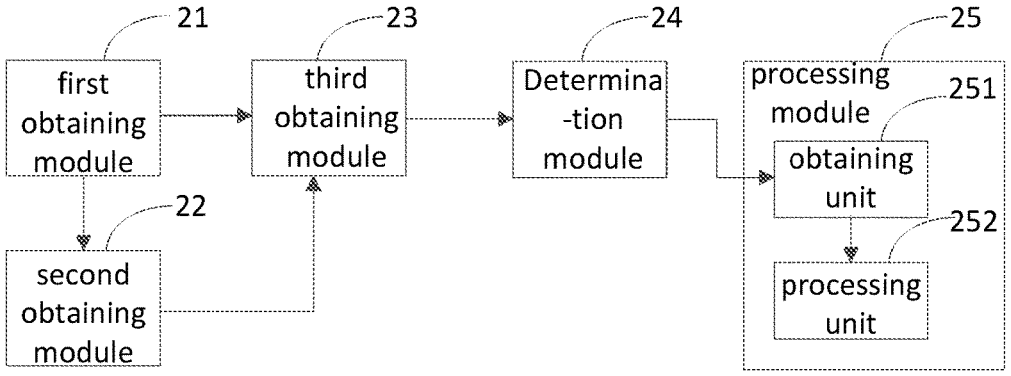
FIG. 3 is a schematic view of the driving device of the display panel in accordance with one embodiment.

FIG. 3 is a schematic view of the driving device of the display panel in accordance with one embodiment. The driving device includes a first obtaining module 21, a second obtaining module 22, a third obtaining module 23, a determination module 24, and a processing module 25.

The first obtaining module 21 is configured to obtain three-color sub-pixel data of each of the pixels of a current image, wherein the three-color sub-pixel data respectively includes a red grayscale value (R1), a green grayscale value (G1), and a blue grayscale value (B1).

The second obtaining module 22 connects to the first obtaining module 21, and the second obtaining module 22 is configured to obtain saturation values corresponding to each of the pixels in accordance with the three-color sub-pixel of each of the pixels obtained by the first obtaining module 21.

Specifically, the saturation values corresponding to each of the pixels may be calculated by the equation:

$$s=\frac{\mathrm{Max}(R1\cdot G1\cdot B1)-\mathrm{Min}(R1\cdot G1\cdot B1)}{\mathrm{Max}(R1\cdot G1\cdot B1)}$$

Wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

The third obtaining module 23 connects to the first obtaining module 21 and the second obtaining module 22, and the third obtaining module 23 is configured to obtain a current background-white ratio of the current image in accordance with the three-color sub-pixel data of each of the pixels obtained by the first obtaining module 21 and the saturation value obtained by the second obtaining module 22, wherein the current background-white ratio is a ratio of the number of the pixels having the saturation value and the three-color sub-pixel data matching predetermined conditions of the current image to a total number of pixels.

In the embodiment, the step of obtaining a current background-white ratio of the current image in accordance with the three-color sub-pixel data of each of the pixels and the saturation value further includes: the third obtaining module 23 defines the pixels having the grayscale value greater than the second predetermined value as a first pixel set, defines the pixels in the first pixel set having the saturation value smaller than the third predetermined value as a second pixel set, defines the number of the pixels in the second pixel set as a first number, and defines the total number of the pixels in the current image as a second number, wherein the background-white ratio is the ratio of the first number to the second number.

The determination module 24 connects to the third obtaining module 23, and the determination module 24 is configured to determine whether the current background-white ratio obtained by the third obtaining module 23 is within a predetermined adjustment range.

In one embodiment, the step of determining whether the current background-white ratio obtained by the third obtaining module 23 is within a predetermined adjustment range further includes: the determination module 24 determines whether the current background-white ratio is greater than the first predetermined value. When the current background-white ratio is greater than the first predetermined value, it is determined that the background-white ratio is within the predetermined adjustment range.

The processing module 25 connects to the determination module 24, and the processing module 25 is configured to reduce a white grayscale value of the four-color sub-pixel data of the current image in accordance with the current background-white ratio and output the reduced white grayscale value to a display panel.

Specifically, the processing module 25 includes an obtaining unit 251 and a processing unit 252. The obtaining unit 251 connects to the determination module 24, and the obtaining unit 251 is configured to obtain the current enhanced coefficient corresponding to the current background-white ratio in accordance with the relationship between the predetermined background-white ratio and the enhanced coefficient. The processing unit 252 connects to the obtaining unit 251, and the processing unit 252 is configured to reduce the white grayscale value of the four-color sub-pixel data corresponding to the current image in accordance with the current enhanced coefficient obtained by the obtaining unit 251.

In view of the above, the driving method includes: obtaining three-color sub-pixel data of each of pixels of a current image, obtaining a saturation value corresponding to each of the pixels in accordance with the three-color sub-pixel data of each of the pixels, obtaining a current background-white ratio in accordance with the three-color sub-pixel data and the saturation value of each of the pixels, determining whether the current background-white ratio is within a predetermined adjustment range, and reducing a white grayscale value of four-color sub-pixel data of the current image in accordance with the current background-white ratio and outputting the reduced white grayscale value to a display panel. In this way, the darker pure-color effect due to the high contrast may be reduced, which effectively enhances the darker pure-color issue of the RGBW display panel.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A driving method of display panels, comprising:

obtaining three-color sub-pixel data of each of pixels of a current image by a first obtaining module;

obtaining saturation values corresponding to each of the pixels in accordance with the three-color sub-pixel data of each of the pixels by a second obtaining module;

obtaining a current background-white ratio in accordance with the three-color sub-pixel data and the saturation values of each of the pixels by a third obtaining module, wherein the current background-white ratio is a ratio of the number of the pixels having the saturation value and the three-color sub-pixel data matching predetermined conditions of the current image to a total number of pixels, the predetermined conditions comprise any one of grayscale values out of a red grayscale value, a green grayscale value, and a blue grayscale value is greater than a second predetermined value and any one of the saturation values of the pixel is smaller than a third predetermined value;

determining whether the current background-white ratio is within a predetermined adjustment range by a determination module;

reducing a white grayscale value of four-color sub-pixel data of the current image in accordance with the current background-white ratio and outputting the reduced white grayscale value to a display panel upon determining whether the current background-white ratio is within the predetermined adjustment range by a processing module;

wherein the step of reducing the white grayscale value of the four-color sub-pixel data of the current image in accordance with the current background-white ratio further comprises:

obtaining a current enhanced coefficient corresponding to the current background-white ratio in accordance with a predetermined relationship between a background-white ratio and an enhanced coefficient by an obtaining unit; and reducing a white grayscale value of the four-color sub-pixel data corresponding to the current image in accordance with the current enhanced coefficient by a processing unit;

wherein the step of determining whether the current background-white ratio is within the predetermined adjustment range further comprises:

determining whether the current background-white ratio is greater than a first predetermined value; and determining the current background-white ratio is within the predetermined adjustment range upon determining the current background-white ratio is greater than the first predetermined value.

2. The driving method as claimed in claim 1, wherein the three-color sub-pixel data respectively comprises the red grayscale value (R1), the green grayscale value (G1), and the blue grayscale value (B1), and wherein the step of obtaining the saturation values corresponding to each of the pixels further comprises:

determining the saturation values corresponding to each of the pixels according to the following formula:

$$s = \frac{\mathrm{Max}(R1 \cdot G1 \cdot B1) - \mathrm{Min}(R1 \cdot G1 \cdot B1)}{\mathrm{Max}(R1 \cdot G1 \cdot B1)};$$

wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

3. The driving method as claimed in claim 1, wherein the step of obtaining the current background-white ratio in accordance with the three-color sub-pixel data and the saturation values of each of the pixels further comprises:

defining the pixels having the grayscale value greater than the second predetermined value as a first pixel set;

defining the pixels in the first pixel set having the saturation value smaller than the third predetermined value as a second pixel set;

defining the number of the pixels in the second pixel set as a first number; defining the total number of the pixels in the current image as a second number;

wherein the background-white ratio is the ratio of the first number to the second number.

4. A driving method of display panels, comprising:

obtaining three-color sub-pixel data of each of pixels of a current image by a first obtaining module;

obtaining saturation values corresponding to each of the pixels in accordance with the three-color sub-pixel data of each of the pixels by a second obtaining module;

obtaining a current background-white ratio in accordance with the three-color sub-pixel data and the saturation values of each of the pixels by a third obtaining module, wherein the current background-white ratio is a ratio of the number of the pixels having the saturation values and the three-color sub-pixel data matching predetermined conditions of the current image to a total number of pixels, wherein the predetermined conditions comprise any one of grayscale values out of a red grayscale value, a green grayscale value, and a blue grayscale value is greater than a second predetermined value and any one of the saturation values of the pixel is smaller than a third predetermined value;

determining whether the current background-white ratio is within a predetermined adjustment range by a determination module; and reducing a white grayscale value of four-color sub-pixel data of the current image in accordance with the current background-white ratio and outputting the reduced white grayscale value to a display panel upon determining whether the current background-white ratio is within the predetermined adjustment range by a processing module.

5. The driving method as claimed in claim 4, wherein the step of reducing the white grayscale value of the four-color sub-pixel data of the current image in accordance with the current background-white ratio further comprises:

obtaining a current enhanced coefficient corresponding to the current background-white ratio in accordance with a predetermined relationship between a background-white ratio and an enhanced coefficient by an obtaining unit; and reducing a white grayscale value of the four-color sub-pixel data corresponding to the current image in accordance with the current enhanced coefficient by a processing unit.

6. The driving method as claimed in claim 4, wherein the step of determining whether the current background-white ratio is within the predetermined adjustment range further comprises:

determining whether the current background-white ratio is greater than a first predetermined value; and determining the current background-white ratio is within the predetermined adjustment range upon determining the current background-white ratio is greater than the first predetermined value.

7. The driving method as claimed in claim 4, wherein the three-color sub-pixel data respectively comprises the red grayscale value (R1), the green grayscale value (G1), and the blue grayscale value (B1), and wherein the step of obtaining the saturation values corresponding to each of the pixels further comprises:

determining the saturation values corresponding to each of the pixels according to the following formula:

$$s = \frac{\mathrm{Max}(R1 \cdot G1 \cdot B1) - \mathrm{Min}(R1 \cdot G1 \cdot B1)}{\mathrm{Max}(R1 \cdot G1 \cdot B1)};$$

wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

8. The driving method as claimed in claim 4, wherein the step of obtaining the current background-white ratio in accordance with the three-color sub-pixel data and the saturation values of each of the pixels further comprises:

defining the pixels having the grayscale value greater than the second predetermined value as a first pixel set;

defining the pixels in the first pixel set having the saturation values smaller than the third predetermined value as a second pixel set;

defining the number of the pixels in the second pixel set as a first number; defining the total number of the pixels in the current image as a second number; and wherein the background-white ratio is the ratio of the first number to the second number.

9. A driving device of display panels, comprising:

a first obtaining module configured to obtain three-color sub-pixel data of each of the pixels of a current image;

a second obtaining module connected to the first obtaining module and configured to obtain saturation values corresponding to each of the pixels in accordance with the three-color sub-pixel of each of the pixels data obtained by the first obtaining module;

a third obtaining module connected to the first obtaining module and the second obtaining module and configured to obtain a current background-white ratio of the current image in accordance with the three-color sub-pixel data of each of the pixels obtained by the first obtaining module and the saturation values obtained by the second obtaining module, wherein the current background-white ratio is a ratio of the number of the pixels having the saturation values and the three-color sub-pixel data matching predetermined conditions of the current image to a total number of pixels, wherein the predetermined conditions comprise any one of grayscale values out of a red grayscale value, a green grayscale value, and a blue grayscale value is greater than a second predetermined value and any one of the saturation values of the pixel is smaller than a third predetermined value;

a determination module connected to the third obtaining module and configured to determine whether the current background-white ratio obtained by the third obtaining module is within a predetermined adjustment range; and a processing module connected to the determination module and configured to reduce a white grayscale value of the four-color sub-pixel data of the current image in accordance with the current background-white ratio and output the reduced white grayscale value to a display panel.

10. The driving device as claimed in claim 9, wherein the processing module further comprises:

an obtaining unit configured to obtain a current enhanced coefficient corresponding to the current background-white ratio in accordance with a predetermined relationship between a background-white ratio and an enhanced coefficient; and a processing unit connected to the obtaining unit and configured to reduce the white grayscale value of the four-color sub-pixel data corresponding to the current image in accordance with the current enhanced coefficient obtained by the obtaining unit.

11. The driving device as claimed in claim 9, wherein the determination module further configured to determine whether the current background-white ratio is greater than the first predetermined value;

when the current background-white ratio is greater than the first predetermined value, the background-white ratio is within the predetermined adjustment range.

12. The driving device as claimed in claim 9, wherein the three-color sub-pixel data respectively comprises the red grayscale value (R1), the green grayscale value (G1), and the blue grayscale value (B1), and the saturation values corresponding to each of the pixels is obtained according to the following formula:

$$s = \frac{\mathrm{Max}(R1 \cdot G1 \cdot B1) - \mathrm{Min}(R1 \cdot G1 \cdot B1)}{\mathrm{Max}(R1 \cdot G1 \cdot B1)};$$

wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

13. The driving device as claimed in claim 9, wherein the third obtaining module further configured to define the pixels having the grayscale value greater than the second predetermined value as a first pixel set;

define the pixels in the first pixel set having the saturation values smaller than the third predetermined value as a second pixel set;

define the number of the pixels in the second pixel set as a first number; and define the total number of the pixels in the current image as a second number, wherein the background-white ratio is the ratio of the first number to the second number.

* * * * *